US010777106B2

(12) United States Patent
Lin et al.

(10) Patent No.: US 10,777,106 B2
(45) Date of Patent: Sep. 15, 2020

(54) DISPLAY QUALITY MONITORING AND CALIBRATION

(71) Applicant: Apple Inc., Cupertino, CA (US)

(72) Inventors: Hung Sheng Lin, San Jose, CA (US); Jie Won Ryu, Campbell, CA (US); Kingsuk Brahma, Mountain View, CA (US); Hyunwoo Nho, Stanford, CA (US); Baris Cagdaser, Sunnyvale, CA (US); Junhua Tan, Santa Clara, CA (US); Sun-Il Chang, San Jose, CA (US); Luigi Panseri, Pleasanton, CA (US); Injae Hwang, Minato-ku (JP); Jesse A. Richmond, San Francisco, CA (US); Toshiaki Sawada, Kodaira (JP); Hyuck-Jae Lee, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 139 days.

(21) Appl. No.: 15/717,755

(22) Filed: Sep. 27, 2017

(65) Prior Publication Data

US 2019/0096300 A1 Mar. 28, 2019

(51) Int. Cl.

| | |
|---|---|
| ***G09G 3/00*** | (2006.01) |
| ***G09G 3/3275*** | (2016.01) |
| *G09G 3/36* | (2006.01) |
| *G09G 3/3225* | (2016.01) |

(52) U.S. Cl.

CPC ..... *G09G 3/006* (2013.01); *G09G 3/3275* (2013.01); *G09G 3/3225* (2013.01); *G09G 3/3648* (2013.01); *G09G 2310/0291* (2013.01); *G09G 2310/08* (2013.01); *G09G 2320/0223* (2013.01); *G09G 2320/043* (2013.01); *G09G 2320/0693* (2013.01); *G09G 2330/027* (2013.01); *G09G 2330/08* (2013.01); *G09G 2330/12* (2013.01)

(58) Field of Classification Search

CPC .... G09G 3/006; G09G 3/3648; G09G 3/3225; G09G 2330/12; G09G 2330/08; G09G 2330/027; G09G 2310/08

See application file for complete search history.

(56) References Cited

U.S. PATENT DOCUMENTS 4,410,850 A * 10/1983 Pesto ..... G01R 31/088 324/519
6,307,681 B1 * 10/2001 Aoki ..... G09G 3/3648 340/14.1
6,545,500 B1 * 4/2003 Field ..... G09G 3/006 324/750.12
8,981,364 B2 * 3/2015 Hong ..... H01L 27/3276 257/40
9,217,902 B1 * 12/2015 Zheng ..... G02F 1/136227
9,501,195 B1 * 11/2016 Kim ..... G02F 1/13338

(Continued)

*Primary Examiner* — Christopher E Leiby
(74) *Attorney, Agent, or Firm* — Fletcher Yoder, P.C.

(57) ABSTRACT

An electronic device includes a display having a number of pixels, source driving circuitry that drives data to the pixels, and data lines that communicatively couple the source driving circuitry with the pixels. The electronic device also includes quality monitoring and calibration circuitry that identifies degradation in the source driving circuitry, one or more of the data lines, or both. The electronic device may be controlled based at least in part upon identification of the degradation.

14 Claims, 12 Drawing Sheets

(56) References Cited

U.S. PATENT DOCUMENTS

| | | | | |
|---|---|---|---|---|
| 2008/0178134 | A1* | 7/2008 | Akamine | G01R 31/3016 716/113 |
| 2009/0174628 | A1* | 7/2009 | Wang | G09G 3/3225 345/76 |
| 2011/0019494 | A1* | 1/2011 | Tsuda | G11C 17/16 365/225.7 |
| 2013/0257836 | A1* | 10/2013 | Chen | G09G 3/3677 345/208 |
| 2018/0067356 | A1* | 3/2018 | Katsuta | G02F 1/1345 |
| 2018/0203046 | A1* | 7/2018 | Takemura | G01R 19/2506 |
| 2018/0374447 | A1* | 12/2018 | Yun | G09G 3/3648 |
| 2019/0064240 | A1* | 2/2019 | Feng | G01R 27/2605 |

* cited by examiner

DISPLAY QUALITY MONITORING AND CALIBRATION

BACKGROUND

This disclosure relates to electronic displays and, more particularly, to techniques to implement quality monitoring and calibration in an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices include an electronic display that displays visual representations based on received image data. More specifically, the image data may include a voltage that indicates desired luminance (e.g., brightness) of a display pixel. For example, in an organic light emitting diode (OLED) display, the image data (e.g., pixel voltage data) may be input to and amplified by one or more amplifiers of a source driver circuit. The amplified pixel voltage may then be supplied to the gate of a switching device (e.g., a thin film transistor) in a display pixel. Based on magnitude of the supplied voltage, the switching device may control magnitude of supply current flowing into a light-emitting component (e.g., OLED) of the display pixel.

From time to time, the systems providing data to the display panel may degrade, causing presentation of artifacts (e.g., dimmer or brighter pixels and/or lines) on the display panel. For example, based upon physical pressure or other external factors, the data lines that carry signals from the source driver to the panel may become damaged (e.g., by cracking). Further, the display panel circuitry (e.g., the source driving circuitry and/or input/output pads) may degrade over time (e.g., due to device aging). These degradations may cause data driving errors. Further, when the data lines/circuitry are used for sensing panel measurements for implementation of panel compensation algorithms, the degradation may result in faulty panel compensation. Accordingly, certain undesirable front-of-screen (FOS) variations may be presented by the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to electronic displays that monitor for degradation in the display circuitry and provide compensation based upon detected degradation. Generally, an electronic display displays an image frame by controlling luminance of its display pixels based at least in part on image data indicating desired luminance of the display pixels. For example, to facilitate displaying an image frame, an organic light emitting diode (OLED) may display may receive image data, amplify the image data using one or more amplifiers, and supply amplified image data to display pixels. When activated, display pixels may apply the amplified image data to the gate of a switching device (e.g., thin-film transistor) to control magnitude of the supply current flowing through a light-emitting component (e.g., OLED). In this manner, since the luminance of OLED display pixels is based on supply current flowing through their light emitting components, the image frame may be displayed based at least in part on corresponding image data.

With this in mind, and to address some of the issues mentioned above, the present techniques provide a system for operating an electronic display to monitor data line capacitance and/or resistance variations, enabling determination of certain degradation characteristics for the display circuitry. For example, reduced data line lengths, degraded source driving circuitry, and other features may be determined based upon the capacitance and/or resistance variations. These determined degradation features may be used to calibrate the display circuitry to counteract or otherwise handle the degradation. Further, the determination of these features may be logged to aid repair of the electronic device by hardware repair technicians.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding additional embodiments that also incorporate the recited features.

Present embodiments relate to improved display circuitry. More specifically, the current embodiments describe techniques and circuits that may detect and/or calibrate for display circuitry degradation.

Figure 1:
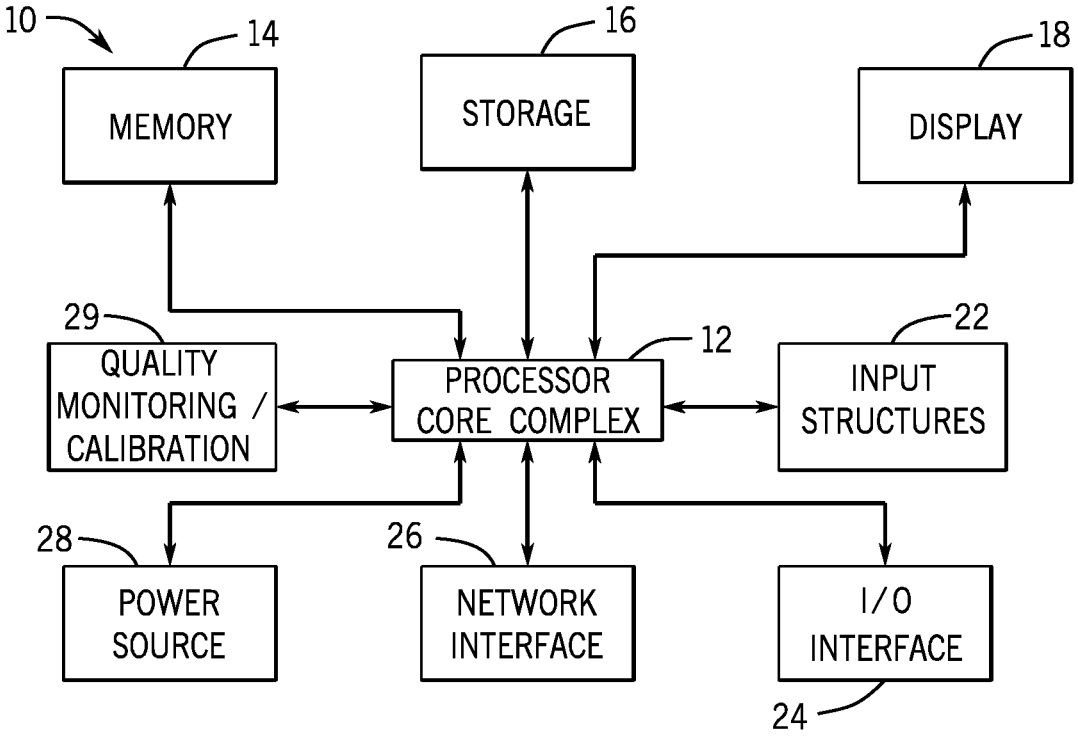
FIG. 1 is a schematic block diagram of an electronic device including a display, in accordance with an embodiment.

Turning first to FIG. 1, an electronic device 10 according to an embodiment of the present disclosure may include, among other things, a processor core complex 12 having one or more processor(s), memory 14, nonvolatile storage 16, a display 18, input structures 22, an input/output (I/O) interface 24, network interfaces 26, and a power source 28. Further, display quality monitoring and/or calibration circuitry 29 may utilize data line charging to detect and/or calibrate for degradation characteristics in the circuitry of the display 18, as will be discussed in more detail below.

The degradation characteristics may be logged (e.g., by storing the characteristics in the storage 16 and/or transferring the characteristics to an external system via the network interface 26). Further, additional contextual data surrounding the degradation characteristics may also be logged. For example, a location (e.g., particular panel portion, particular data line numbers, etc.) may be logged. Further, historical degradation and/or degradation trends may be logged. Additionally, electronic device 10 or electronic device 10 subcomponent temperatures and/or other variables may be logged.

Device repair may be aided by logging the degradation characteristics and/or the surrounding contextual data. For example, a technician may be able to ascertain particular degraded components, their locations, and other pertinent information that may be useful in repair of the electronic device 10. Further, this logged information may be used by the device manufacturer to enhance future revisions of the products or aid in the development of new products, by identifying strengths and/or potential improvements to the designed circuitry.

The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
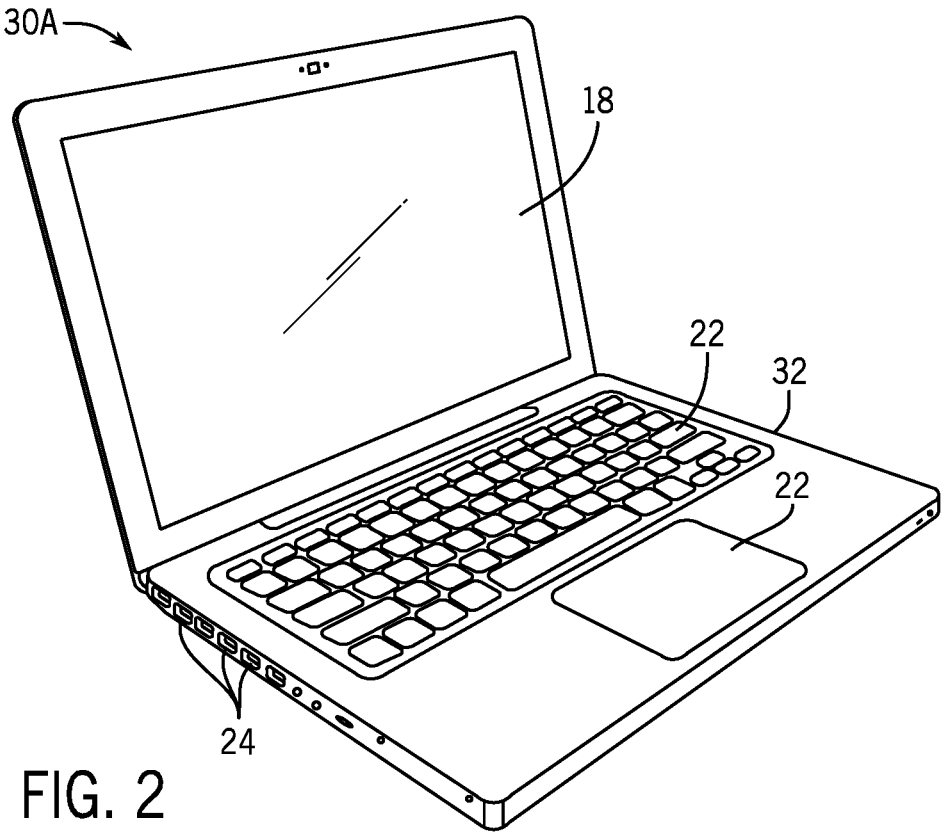
FIG. 2 is a perspective view of a notebook computer representing an embodiment of the electronic device of FIG. 1, in accordance with an embodiment.
Figure 4:
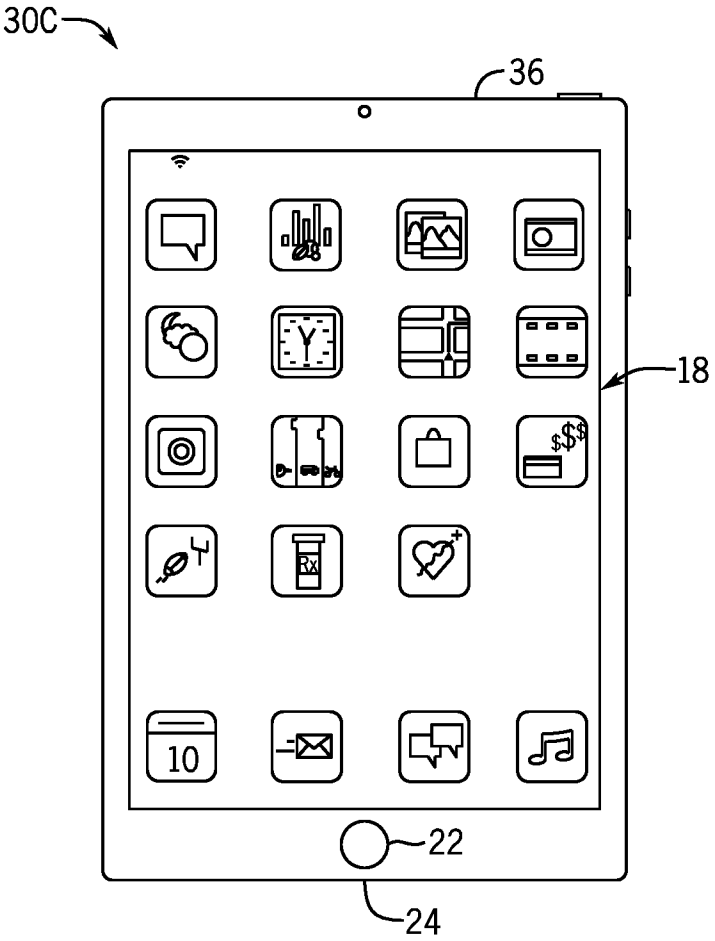
FIG. 4 is a front view of another hand-held device representing another embodiment of the electronic device of FIG. 1, in accordance with an embodiment.
Figure 3:
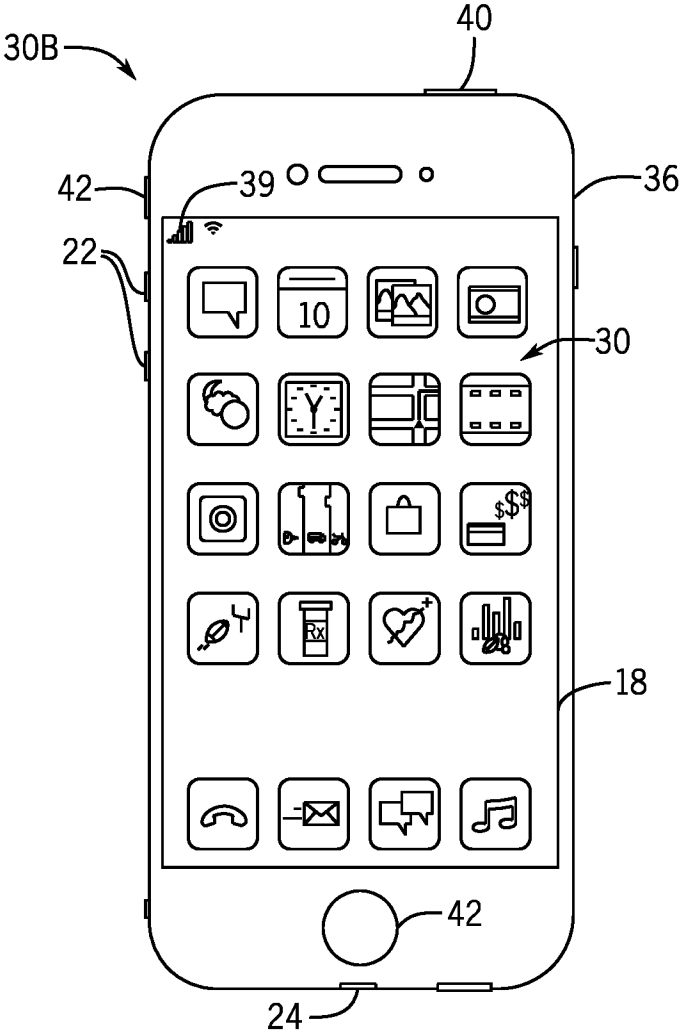
FIG. 3 is a front view of a hand-held device representing another embodiment of the electronic device of FIG. 1, in accordance with an embodiment.
Figure 5:
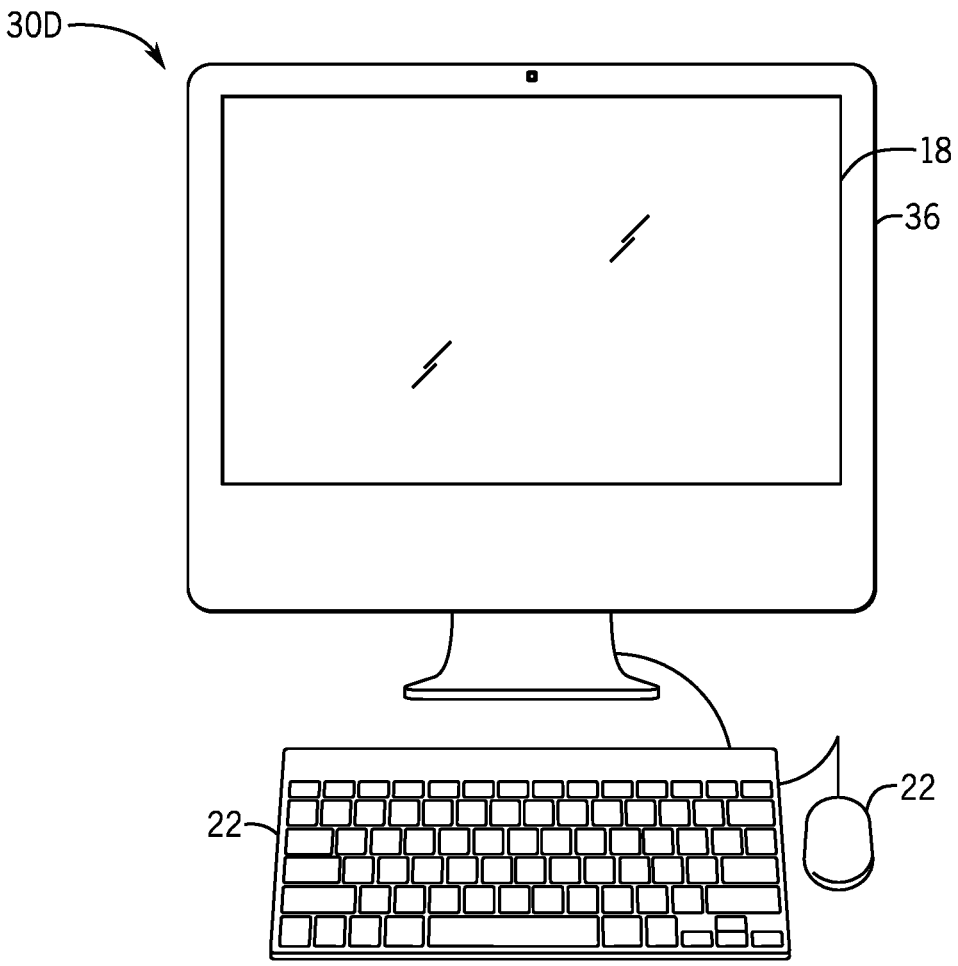
FIG. 5 is a front view of a desktop computer representing another embodiment of the electronic device of FIG. 1, in accordance with an embodiment.
Figure 6:
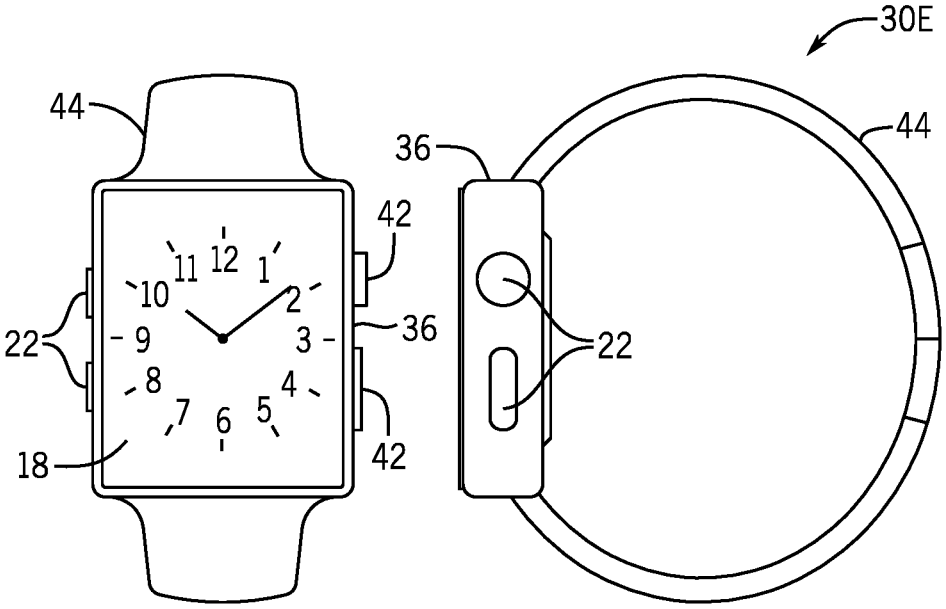
FIG. 6 is a front view of a wearable electronic device representing another embodiment of the electronic device of FIG. 1, in accordance with an embodiment.

By way of example, the electronic device 10 may represent a block diagram of a notebook computer 30A depicted in FIG. 2, a handheld device 30B depicted in FIG. 3, a handheld device 30C depicted in FIG. 4, a desktop computer 30D depicted in FIG. 5, a wearable electronic device 30E depicted in FIG. 6, or similar devices. It should be noted that the processor core complex 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor core complex 12 and/or other data processing circuitry may be operably coupled with the memory 14 and the nonvolatile storage 16 to perform various algorithms. Such programs or instructions executed by the processor core complex 12 may be stored in any suitable article of manufacture that may include one or more tangible non-transitory computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor core complex 12 to enable the electronic device 10 to provide various functionalities.

The display 18 may be a liquid crystal display (LCD) and/or may include pixels such as organic light emitting diodes (OLEDs), micro-light-emitting-diodes (μ-LEDs), or any other light emitting diodes (LEDs). Further, the display 18 is not limited to a particular pixel type, as the circuitry and methods disclosed herein may apply to any pixel type. Accordingly, while particular pixel structures may be illustrated in the present disclosure, the present disclosure may relate to a broad range of lighting components and/or pixel circuits within display devices.

Compensation circuitry may alter display data that is fed to the display 18, prior to the display data reaching this display 18 (or a pixel portion of the display 18). This alteration of the display data may effectively compensate for non-uniformities of the pixels of the display 18. For example, non-uniformity that may be corrected using the current techniques may include: neighboring pixels that have similar data, but different luminance, color non-uniformity between neighboring pixels, pixel row inconsistencies, pixel column inconsistencies, etc. The compensation circuitry may be part of the processor core complex 12, could be software executed by the processor core complex 12, could be part of the display 18 circuitry (e.g., the display pipeline), etc.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., 15SL, VDSL), digital video broadcasting-terrestrial (DVB-T) and its extension DVB Handheld (DVB-H), ultra Wideband (UWB), alternating current power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10, in the form of a computer, may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 30B. For example, the input structure 40 may activate or deactivate the handheld device 30B, the input structure 22 may navigate user interface to a home screen, a user-configurable application screen, and/or activate a voice-recognition feature of the handheld device 30B, the input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 30C which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 (e.g., mouse and/or keyboard), which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 44, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen, which may allow users to interact with a user interface of the wearable electronic device 30E.

The display 18 for the electronic device 10 may include a matrix of pixels that contain light emitting circuitry.

Figure 7:
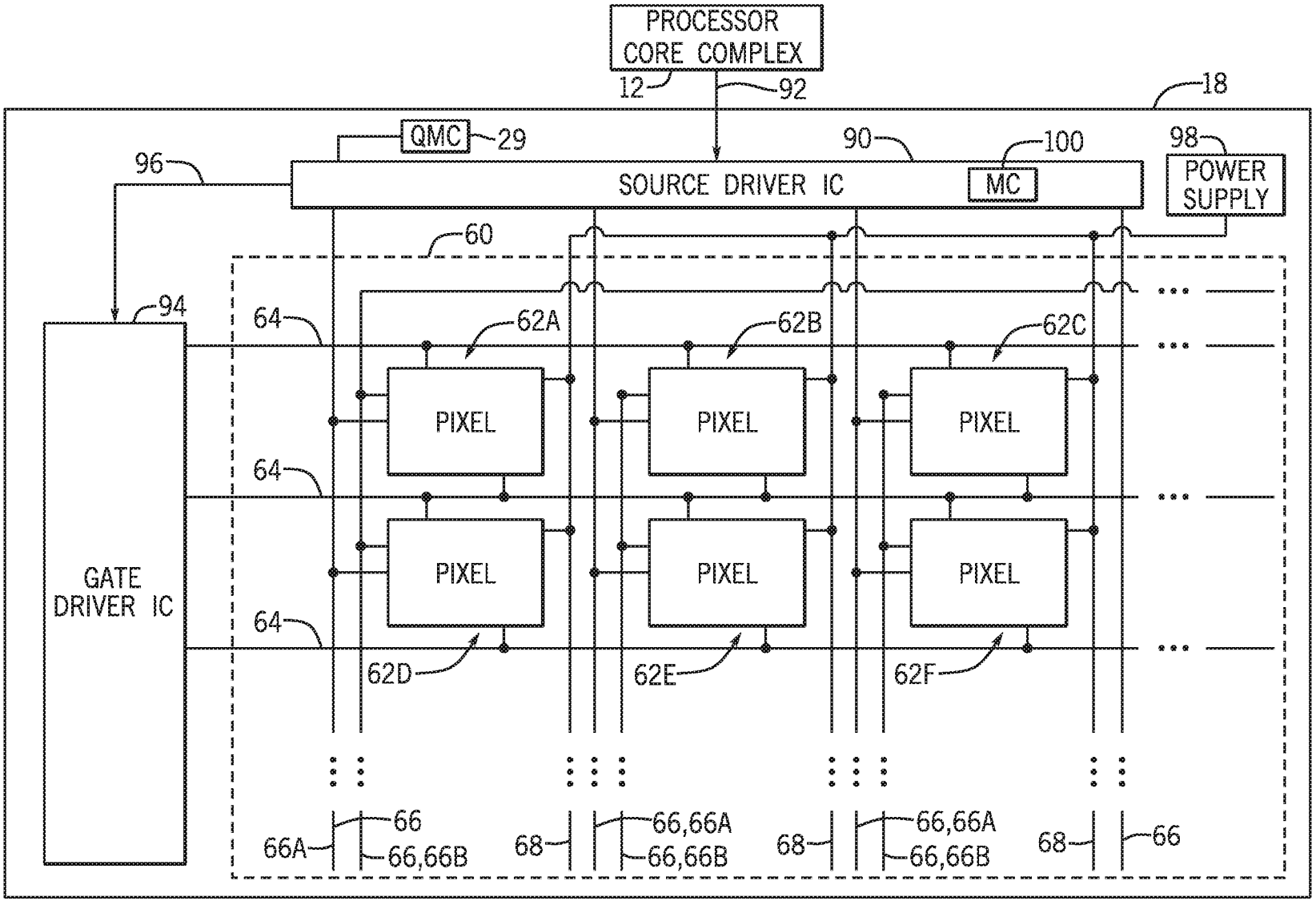
FIG. 7 is a circuit diagram illustrating a portion of an array of pixels of the display of FIG. 1, in accordance with an embodiment.

Accordingly, FIG. 7 illustrates a circuit diagram including a portion of a matrix of pixels of the display 18. As illustrated, the display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the display 18, in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62. The unit pixels 62 may include, for example, a thin film transistor (TFT) coupled to a LED, whereby the TFT may be a driving TFT that facilitates control of the luminance of a display pixel 62 by controlling a magnitude of supply current flowing into the LED (e.g., an OLED) of the display pixel 62 or a TFT that controls luminance of a display pixel by controlling the operation of a liquid crystal.

Although only six unit pixels 62, referred to individually by reference numbers 62*a*-62*f*, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. By way of further example, the panel 60 may have a resolution of 480×320 or 960×640. In the presently illustrated example, the unit pixels 62 may represent a group of pixels having a red pixel (62A), a blue pixel (62B), and a green pixel (62C). The group of unit pixels 62D, 62E, and 62F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel."

The display 18 also includes a source driver integrated circuit (IC) 90, which may include a chip, such as a processor or application specific integrated circuit (ASIC), that controls various aspects (e.g., operation) of the display 18 and/or the panel 60. For example, the source driver IC 90 may receive image data 92 from the processor core complex 12 and send corresponding image signals to the unit pixels 62 of the panel 60. The source driver IC 90 may also be coupled to a gate driver IC 94, which may provide/remove gate activation signals to activate/deactivate rows of unit pixels 62 via the gate lines 64. Additionally, the source driver IC 90 may include a timing controller (TCON) that determines and sends timing information/image signals 96 to the gate driver IC 94 to facilitate activation and deactivation of individual rows of unit pixels 62. In other embodiments, timing information may be provided to the gate driver IC 94 in some other manner (e.g., using a controller that is separate from the source driver IC 90). Further, while FIG. 7 depicts only a single source driver IC 90, it should be appreciated that other embodiments may utilize multiple source driver ICs 90 to provide timing information/image signals 96 to the unit pixels 62. For example, additional embodiments may include multiple source driver ICs 90 disposed along one or more edges of the panel 60, with each source driver IC 90 being configured to control a subset of the data lines 66 and/or gate lines 64.

In operation, the source driver IC 90 receives image data 92 from the processor core complex 12 or a discrete display controller and, based on the received data, outputs signals to control operation (e.g., light emission) of the unit pixels 62. When the unit pixels 62 are controlled by the source driver IC 90, circuitry within the unit pixels 62 may complete a circuit between a power source 98 and light emitting elements of the unit pixels 62. Additionally, to measure operating parameters of the display 18, measurement circuitry 100 may be positioned within the source driver IC 90 to read various voltage and current characteristics of the display 18, as discussed in more detail below.

The measurements from the measurement circuitry 100 (or other information) may be used to determine offset data for individual pixels (e.g., 62A-F). The offset data may represent non-uniformity between the pixels, such as: neighboring pixels that have similar data, but different luminance, color non-uniformity between neighboring pixels, pixel row inconsistencies, pixel column inconsistencies, etc. Further, the offset data may be applied to the data controlling the pixels (e.g., 62A-F), resulting in compensated pixel data that may effectively remove these inconsistencies. In some embodiments, the external compensation circuitry may include one or more of the source driver IC 90 and the measurement circuitry 100 or may be coupled to one or more of the source driver IC 90 and the measurement circuitry 100.

From time to time, the systems providing data to the display panel may degrade, causing presentation of artifacts (e.g., dimmer or brighter pixels and/or lines) on the display panel. For example, based upon physical forces or other external factors, the data lines 66 that carry signals from the source driver IC 90 to the pixels 62 may become damaged (e.g., cracking). Further, the display 18 circuitry (e.g., the source driving integrated circuitry 90 and/or input/output pads) may degrade over time (e.g., due to device aging). These degradations may cause data driving errors to the pixels 62.

Further, as mentioned above, the measurement circuitry 100 may read various voltage and current characteristics of the display 18 (e.g., using the data lines 66), such that subsequent data provided to the pixels 62 may be adjusted based upon the measurements obtained by the measurement circuitry 100 via the data lines 66. Accordingly, the data lines 66 may be alternatively referenced as the data/sensing lines 66. However, when degradation occurs on these data lines 66 and/or other circuitry used by the measurement circuitry 100, the data compensation for the measurements may be erroneous.

Figure 8:
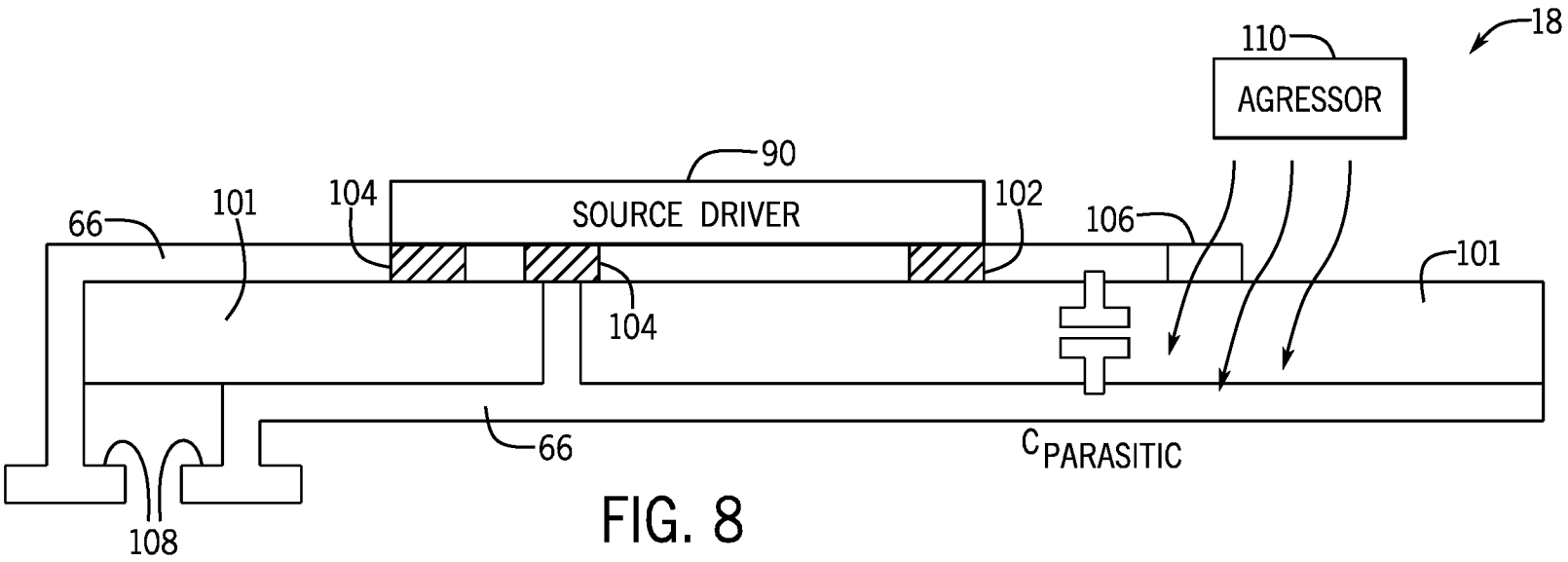
FIG. 8 is a schematic diagram illustrating a cross-section of display circuitry, in accordance with an embodiment.

For example, FIG. 8 is a schematic diagram illustrating a cross-section of display 18 circuitry, having a chip on flex (COF) 101 assembly, in accordance with an embodiment. The source driver integrated circuit 90 may include input pads 102 for receiving input data and output pads 104 for providing output data. As illustrated, the input pads 102 may be communicatively coupled with other pads 106, while output pads 104 may be communicatively coupled with pads 108 that provide driven data to the display 18 panel. The coupling of the input pads 102 and/or output pads 104 may degrade over time (e.g., because they may be susceptible to physical stress, etc.). For example, for soldered connections, corrosion or vibration may be introduced, degrading the soldering. Further, aggressors 110 to the data lines 66 may result in parasitic capacitance on a sensitive trace of the data lines 66. Further, the slew rate of the source driver integrated circuit 90 may degrade over time.

When undetected and untreated, these degradations may cause artifacts to be presented on the display 18 panel. For example, open data lines 66 (e.g., lines where there is a complete break between the pixels 62 and the driver integrated circuit 90) may be displayed as a bright or dim line. Further, when the source drive integrated circuit 90 slew rate degrades (e.g., the resistance on the line increases), certain areas of the display 18 panel may appear dimmer than others.

Accordingly, returning to FIG. 7, the Quality Monitoring and/or Calibration ("QMC") circuitry 29 may be coupled to the source driver IC 90 and/or the data lines 66 to monitor for degradation in the display 18 circuitry or may be implemented via software executed by a processor of the processor core complex 12. For example, the QMC circuitry 29 may monitor for data line 66 degradation and/or source driver IC 90 degradation, as will be discussed in more detail below.

Figure 9:
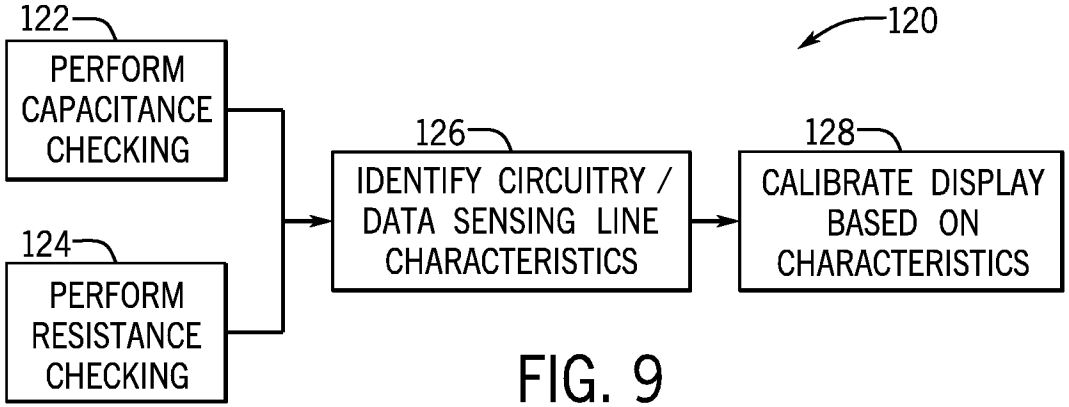
FIG. 9 is a flowchart illustrating a process for detecting degradation in a display and calibrating the display based upon the degradation, in accordance with an embodiment.
Figure 10B:
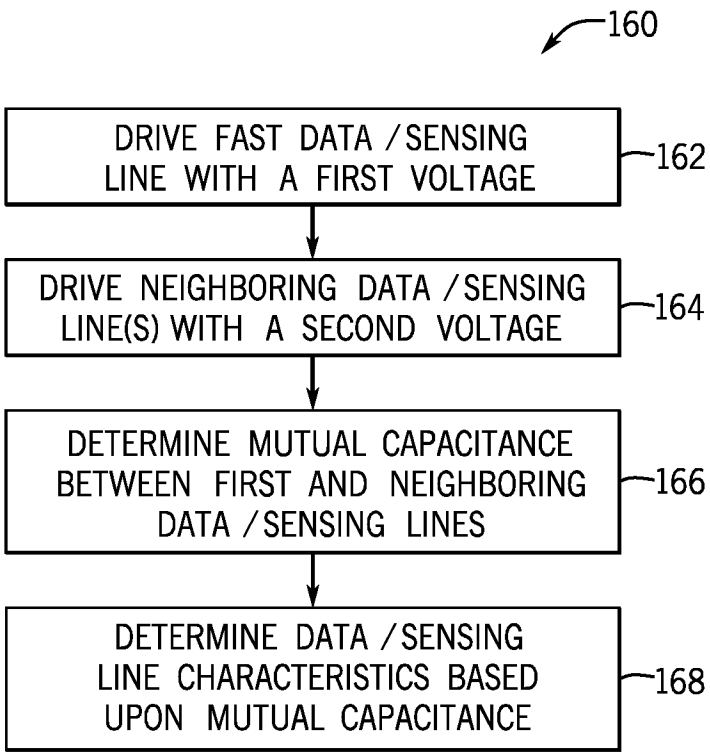
FIG. 10B is a flowchart illustrating a process for using varied charges on neighboring lines to detect degradation, in accordance with an embodiment.
Figure 10A:
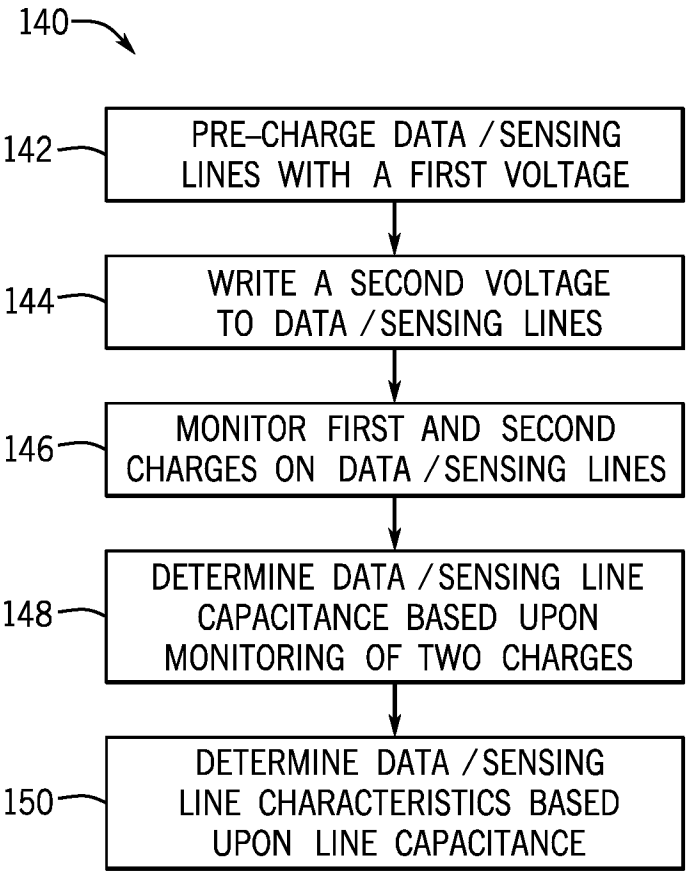
FIG. 10A is a flowchart illustrating a process for using differing charges on a data/sensing line to detect degradation, in accordance with an embodiment.

Turning now to a discussion of the inner-workings of the QMC circuitry 29, FIG. 9 is a flowchart 120 illustrating a process for detecting degradation in a display 18 and calibrating the display 18 based upon the degradation, in accordance with an embodiment. The process 120 includes performing one or more capacitance-based tests on the data lines 66 (block 122) and/or one or more resistance-based tests on the data lines 66 (block 124). FIGS. 10A and 10B, discussed below, provide details pertaining to the capacitance-based test and FIG. 11, discussed below, provides details pertaining to the resistance-based test.

The results of these tests may be used to identify display 18 circuitry and/or data/sensing line degradation characteristics (block 126). For example, the tests may be used to determine potential breaks in one or more of the data lines 66, by determining a length of each of the data lines. Further, a determination of distances between neighboring data lines 66 may be determined, which may further indicate display 18 circuitry degradation/damage. Based upon the determined characteristics, the display 18 may be calibrated (block 128), as will be discussed in more detail below, with regard to FIG. 12.

Turning now to a discussion of the capacitance-based tests, FIG. 10A is a flowchart illustrating a process 140 for using differing charges on a data/sensing line to detect degradation, in accordance with an embodiment. In the process 140, the data/sensing lines 66 are pre-charged with a first voltage (block 142). A second voltage is then written to the data/sensing lines (block 144). Charges resulting from the pre-charging of block 142 and the writing of the second charge of block 144 or monitored (block 146).

Based upon the charge differentiation on the data/sensing lines 66 that are caused by the actions of blocks 142 and 144, the capacitance of the data/sensing lines 66 may be determined. The capacitance may be used to determine degradation characteristics (block 150). For example, the capacitance of the lines 66 is proportional to the length of the lines 66. Accordingly, the capacitance may be used as an index for crack detection (e.g., because the length of the line will change upon cracking).

Additional capacitance testing may also be utilized to determined degradation characteristics. FIG. 10B is a flowchart illustrating a process 160 for using varied charges on neighboring lines to detect degradation, in accordance with an embodiment. The process 160 may be independent from or used in conjunction with the process 140 of FIG. 10A.

The process 160 begins by driving a first data/sensing line 66 with a first voltage (block 162). Neighboring data/sensing lines are driven with a second voltage (block 164). Based upon these differing voltages, a mutual capacitance may be derived between the first and neighboring data/sensing lines 66 (block 166). Degradation characteristics may be determined based upon the determined mutual capacitance (block 168). For example, distances between the data/sensing lines may be determined using the mutual capacitance.

Figure 11:
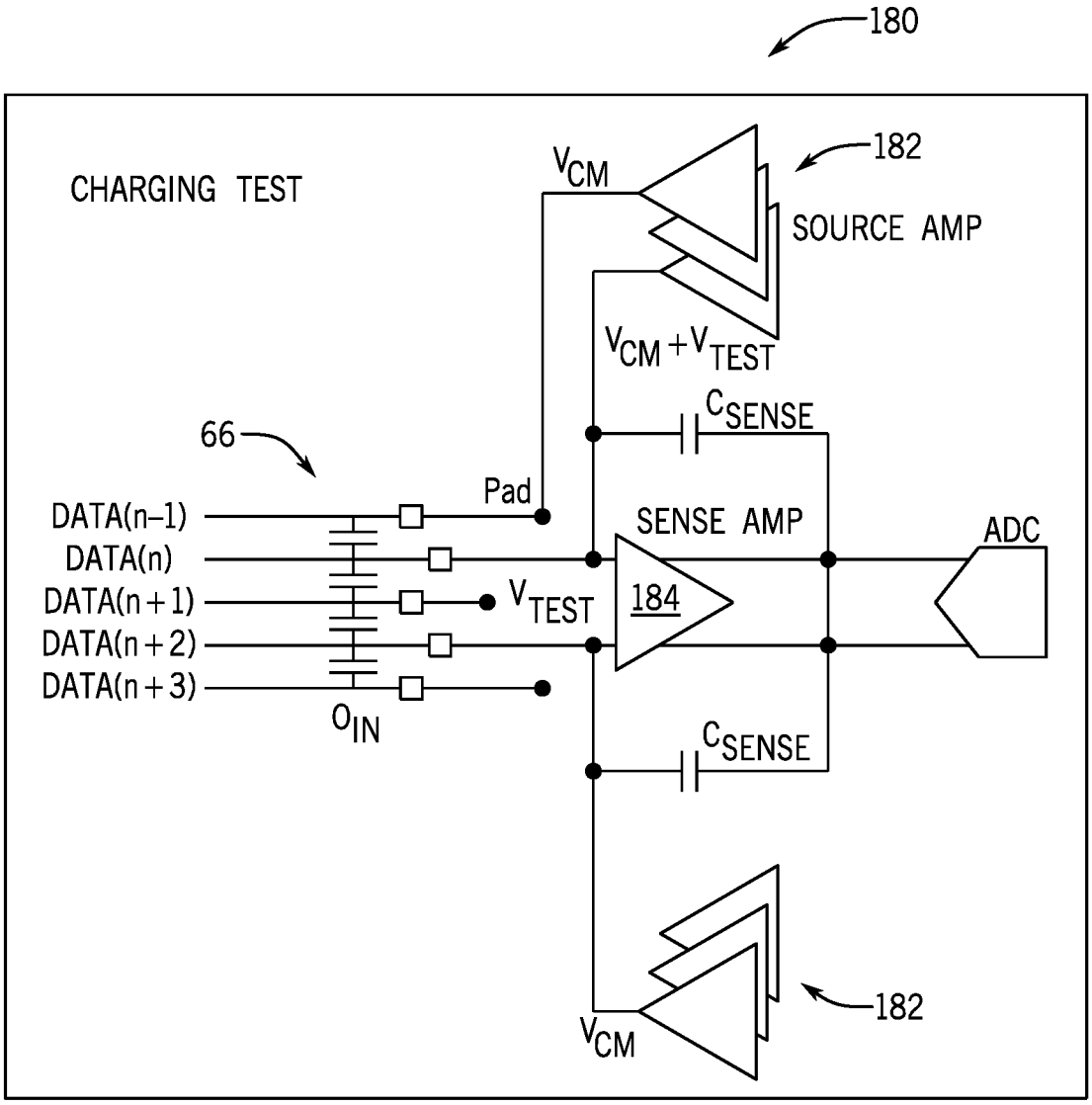
FIG. 11 is a schematic diagram illustrating circuitry for implementing the processes of FIGS. 10A and 10B, in accordance with an embodiment.

FIG. 11 is a schematic diagram illustrating circuitry 180 for implementing the processes of FIGS. 10A and 10B, in accordance with an embodiment. In the circuitry 180, the data/sensing lines 66 are pre-charged with a first and second voltages according to blocks 142 and 144 using the driving circuitry 182. The capacitance of the data/sensing lines 66 are monitored by transferring the data/sensing line 66 charges to the sense amp 184. The coupling capacitor (Cin) is proportion to the data line length and, thus, can be used as an index for crack detection, according to:

$$VOUT=VTEST\times CIN/CSENSE$$

Further, differing voltages may be driven to neighboring data/sensing lines 66, as discussed in blocks 162 and 164 of FIG. 10B. This enables determination of a distance between the neighboring lines 66.

Figure 12:
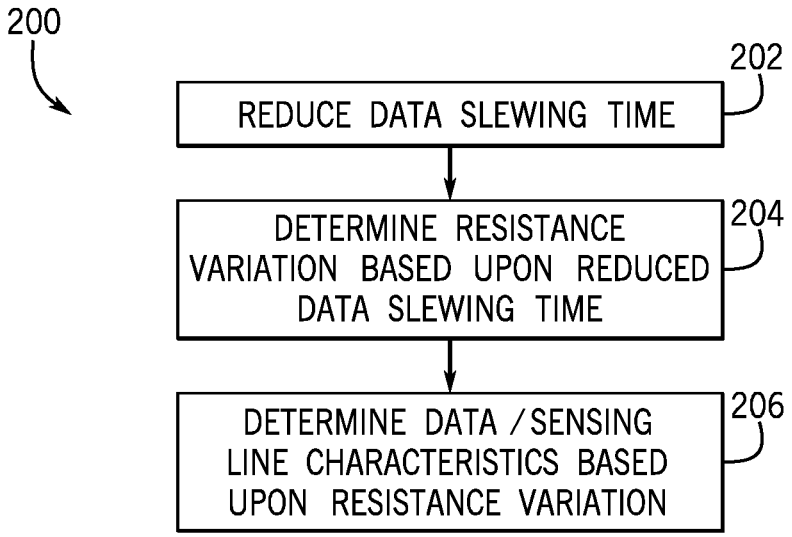
FIG. 12 is a flowchart illustrating a process for using line resistance to determine degradation, in accordance with an embodiment.

Turning now to a discussion of the resistance-based test, FIG. 12 is a flowchart illustrating a process 200 for using line resistance to determine degradation, in accordance with an embodiment. The resistance-based test may be useful when the degradation does not completely open the data/sensing lines 66 (e.g., when a crack does not sever a data/sensing line 66).

The process 200 begins by reducing a data slewing time (e.g., time allowed to reach a steady voltage) during charging of the data/sensing lines 66. As may be appreciated, the slew rate may be defined as the change of voltage per unit of time. To reduce the data slewing time, the data/sensing lines 66 may be charged for a fixed amount of time less than a time used to reach a steady voltage on the data/sensing lines 66. By reducing the data slewing time, the amount of charge on the data/sensing lines 66 is dependent on the resistance of the data/sensing lines 66.

Accordingly, the resistance variation on the data/sensing lines 66 may be determined based upon the reduced data slewing time (block 204). This resistance value provides an indication of degradation between the source driving integrated circuitry 90 and the data/sensing lines 66 (block 206). For example, internal resistance variations of the source driver IC 90 caused by degradation of the source driver IC 90 may be detected. Further, bonding resistance variation (e.g., at pads between the source driver IC 90 and the data/sensing lines 66) may be identified.

Figure 13:
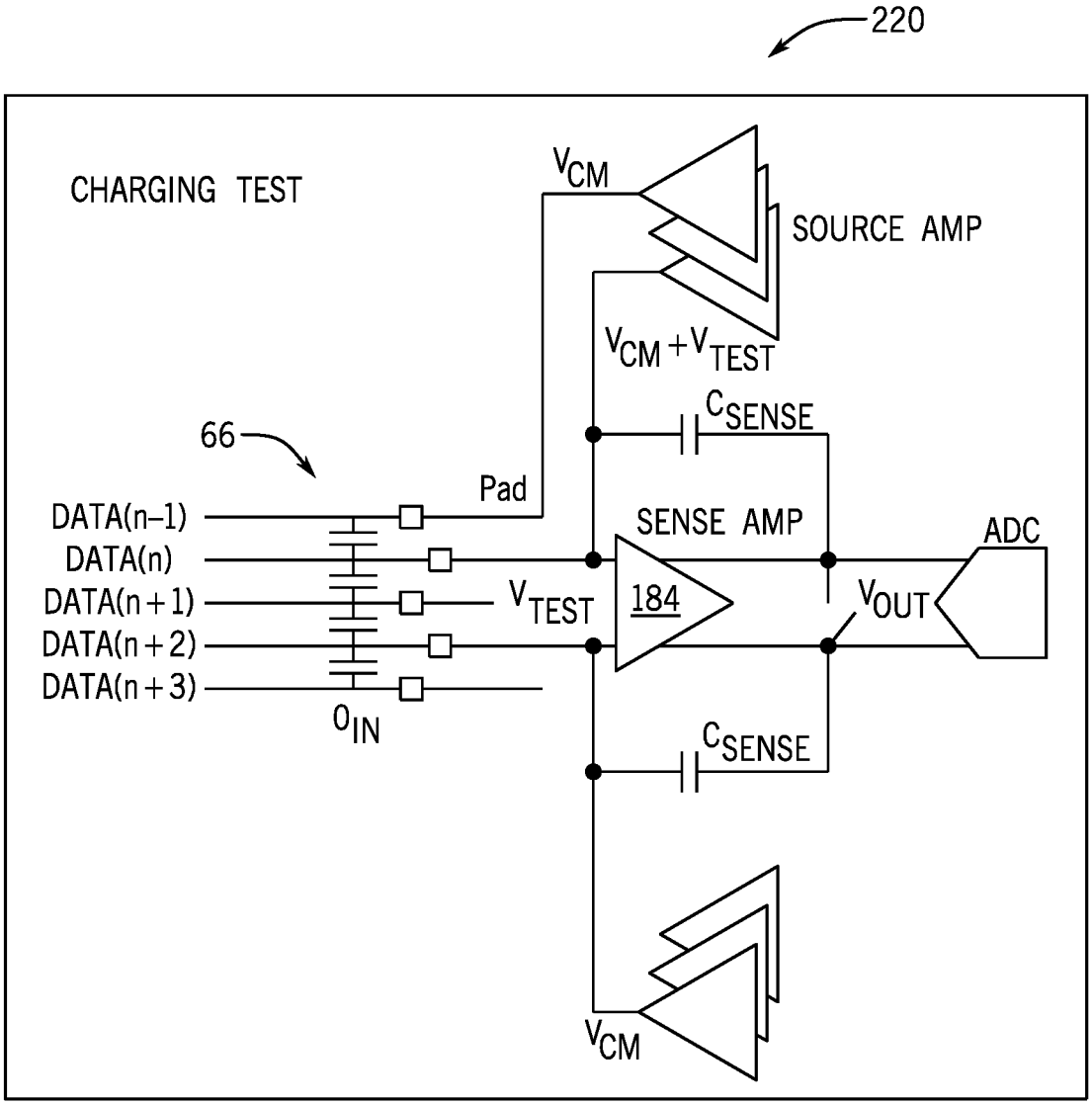
FIG. 13 is a schematic diagram illustrating circuitry for implementing the process of FIG. 12, in accordance with an embodiment.

FIG. 13 is a schematic diagram illustrating circuitry 220 for implementing the process of FIG. 12, in accordance with an embodiment. By reducing the data slewing time (block 202 of FIG. 12), the adjusted current (ISLEW) of the amplifier can be characterized according to:

$$VTEST=ISLEW\times TSLEW/CIN$$

$$\rightarrow VOUT=VTEST\times ISLEW\times TSLEW/CSENSE$$

Figure 14:
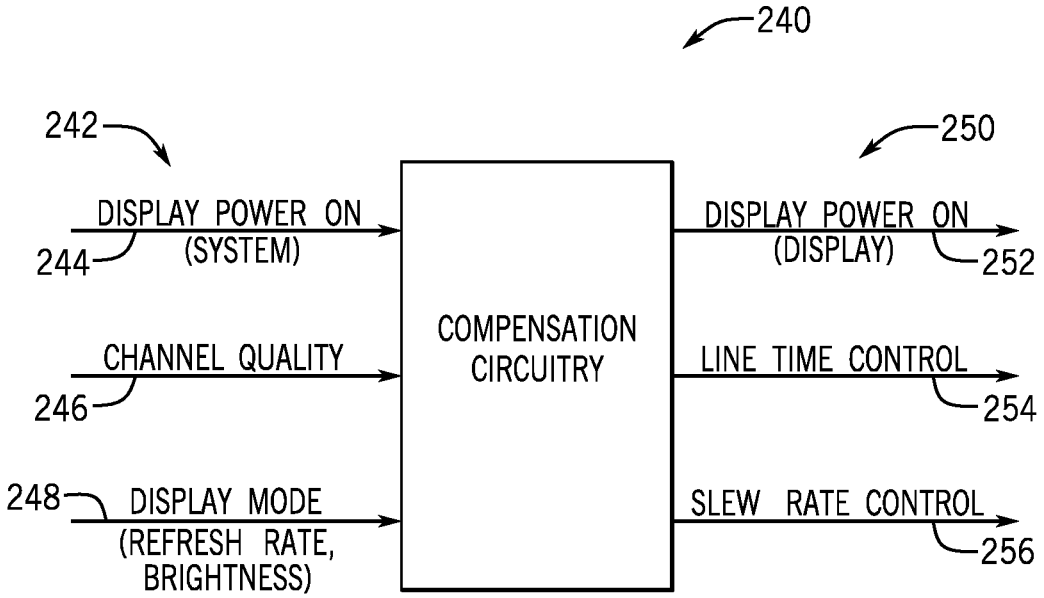
FIG. 14 is a schematic diagram illustrating circuitry for compensation based upon detected degradation, in accordance with an embodiment.

Turning now to compensation for detected degradation, FIG. 14 is a schematic diagram illustrating compensation circuitry 240 for compensation based upon detected degradation, in accordance with an embodiment. As illustrated, the compensation circuitry 240 may receive input data 242, such as a power on status 244, a channel quality 246 (e.g., the determined degradation characteristics from the processes 140, 160, and/or 200), and display mode configurations 248 (e.g., refresh rate settings, brightness, etc.).

In one embodiment, the compensation circuitry 240 may request and receive channel quality 246 inputs each time it receives an indication of a display power ON 244 being initiated. Based upon the channel quality, the compensation circuitry 240 may control the display 18 via certain outputs 250.

For example, in certain scenarios, the compensation circuitry 240 may control the display 18 power on process via output 252. For example, in some embodiments, if a channel is completely open, meaning data will not reach pixels of the channel, the display 18 power on may be cancelled, resulting in the display 18 remaining in an off state. Alternatively, the compensation circuitry 240 may power off certain degraded channels, while powering on other channels.

In some embodiments, the compensation circuitry may, based upon channel quality, alter a line time control via line time control output 254 and/or a slew rate via the slew rate control 256. By adjusting the line time, the compensation circuitry 240 may allow more time for data transmission to the data/sensing lines 66, in an effort to compensate for degradation on the data/sensing lines 66. Adjustment of the slew rate may compensate for degraded slew rate of the source driver IC 90.

Figure 15:
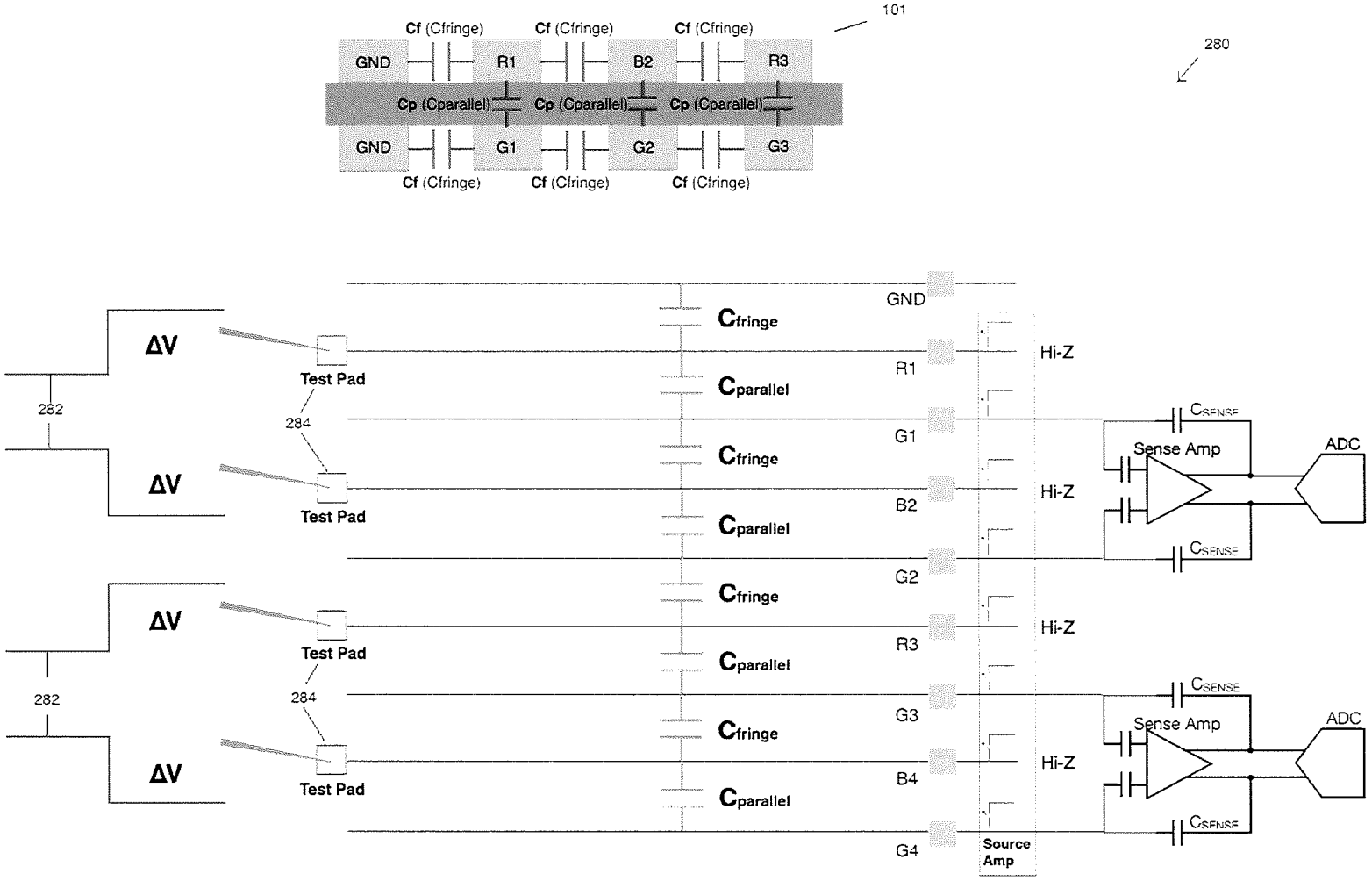
FIG. 15 is a schematic diagram illustrating COF testing using an external stimulus, in accordance with an embodiment.
Figure 16:
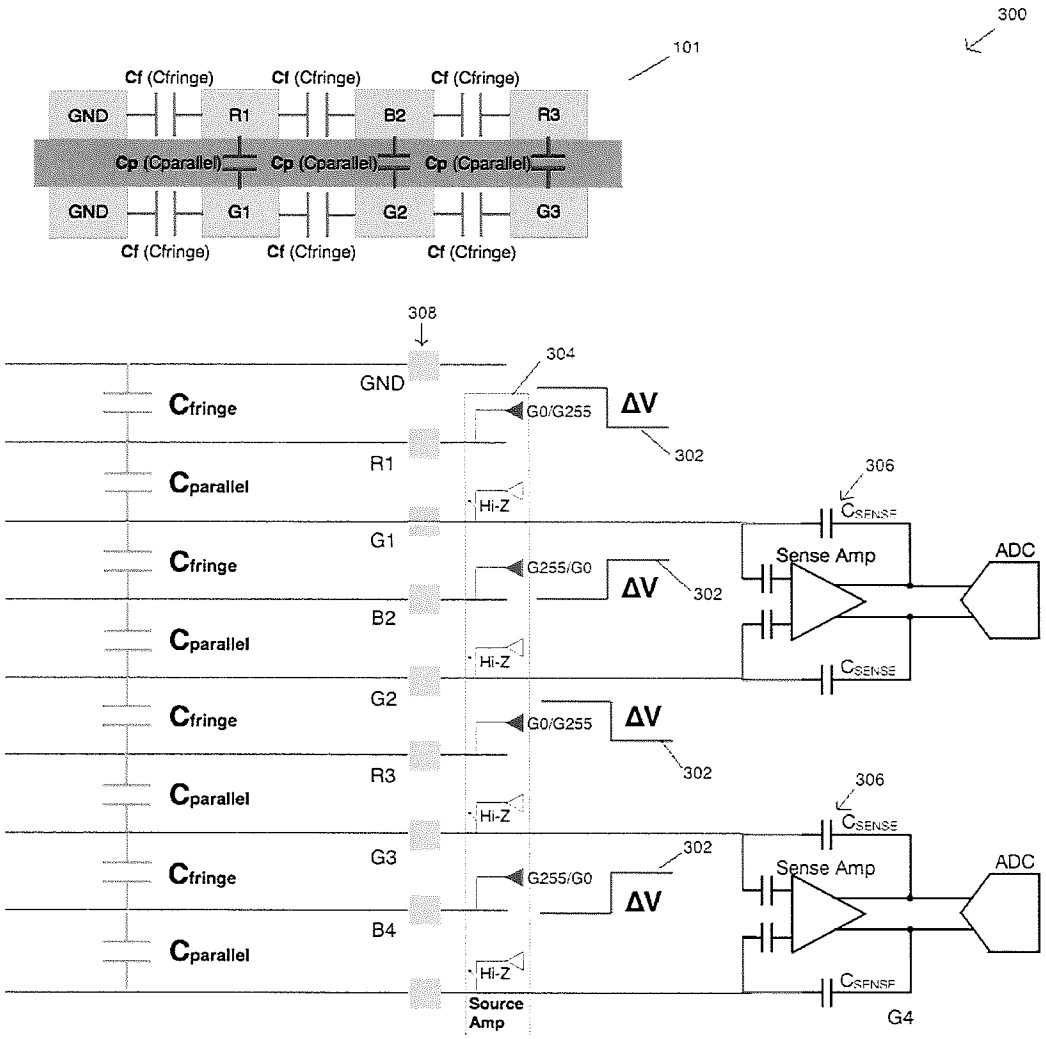
FIG. 16 is a schematic diagram illustrating COF testing using on-chip (source driver) stimulus, in accordance with an embodiment.

FIGS. 15 and 16 illustrate embodiments of COF 101 testing. FIG. 15 is an embodiment 280 of COF testing using an external stimulus 282 (e.g., AV) introduced through test pads 284. As illustrated in the COF 101 of FIG. 15, there may be top and bottom parallel routing in parts of the COF 101. Even/odd row source driver control may be used to perform a short test. The outer row open/short/gray test may be conducted via the test pads 284. Further, for the inner rows, inner row sensing may be completed via external stimulus 282 driving.

FIG. 16 illustrates an embodiment 300 of COF 101 testing using on-chip (e.g., source driver) stimulus 302. The embodiment 300 may uses an even/odd separate drive/sense configuration. First, varying levels of stimulus 302 (e.g., $\Delta V$) are stepped through with the source amplifier 304. The sensing amp 306 may be used to sense via pads 308 (e.g., the inner row pads of pads 308). Iterative sensing by the sensing amp 306 may be performed by switching sensed pad pairs coupled to the sensing amp 306, enabling full pad 308 coverage.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device, comprising:

a processor configured to generate image data and provide the image data to a display; and the display, comprising:

a plurality of pixels;

source driving circuitry, configured to receive the image data and cause the display to display visual representations by driving the image data to the plurality of pixels to cause the pixels to emit a desired luminance; and data lines that communicatively couple the source driving circuitry with the plurality of pixels;

quality monitoring and calibration circuitry, configured to:

identify degradation in the source driving circuitry, one or more of the data lines, or both, by measuring one or more signals provided through the data lines from the source driving circuitry, the measuring comprising:

performing a resistance test, wherein the resistance test comprises:

charging the data lines with a reduced data slewing time by:

charging the data lines for a fixed amount of time that is less than an amount of time that would result in a steady charge on the data lines; and determining a resistance variation of the data lines based upon the reduced data slewing time; or identifying distances between the data lines by:

driving a first data line of the data lines at a first voltage;

driving a neighboring data line of the first data line at a second voltage different than the first voltage; and calculating a mutual capacitance between a first data line and a neighboring data line, based upon a difference in voltage of the first voltage and the second voltage; and control circuitry, configured to:

control the electronic device, based at least in part upon identification of the degradation.

2. The electronic device of claim 1, wherein the quality monitoring and calibration circuitry is configured to identify degradation in the source driving circuitry, one or more of the data lines, or both, by identifying line lengths of the data lines by performing a capacitance test, wherein the capacitance test comprises providing a first and a second charge to the data lines and monitoring a difference in charge between providing the first and the second charges.

3. The electronic device of claim 1, wherein the quality monitoring and calibration circuitry is configured to attribute the resistance with bonding resistance variation.

4. The electronic device of claim 1, wherein the quality monitoring and calibration circuitry is configured to attribute the resistance with degradation of the source driving circuitry.

5. The electronic device of claim 1, comprising a non-transitory storage, wherein the processor causes logging of the degradation in the storage.

6. The electronic device of claim 5, comprising a non-transitory storage, wherein the processor causes contextual data surrounding the degradation to be logged in the non-transitory storage.

7. The electronic device of claim 1, wherein the quality monitoring and calibration circuitry is configured to return the display to a powered off state based upon the degradation.

8. The electronic device of claim 1, wherein the quality monitoring and calibration circuitry is configured to adjust a data line time allotted for sending the data to one or more of the data lines to compensate for the degradation.

9. The electronic device of claim 1, wherein the quality monitoring and calibration circuitry is configured to adjust a slew rate allotted for reaching a charge to compensate for the degradation.

10. An electronic device-implemented method implemented by quality monitoring and calibration circuitry of the electronic device, comprising:

identifying degradation in a source driving circuitry of a display of the electronic device, one or more data lines of the display, or both, based at least in part upon:

identifying distances between the data lines, by the electronic device, by:

driving a first data line of the one or more data lines at a first voltage;

driving a neighboring data line of the first data line at a second voltage different than the first voltage; and calculating a mutual capacitance between a first data line and a neighboring data line, based upon a difference in voltage of the first voltage and the second voltage; or a resistance test, performed by the electronic device, that measures a resistance by charging the data lines with a reduced data slewing time by:

charging the data lines for a fixed amount of time that is less than an amount of time that would result in a steady charge on the data lines; and determining a resistance variation of the data lines based upon the reduced data slewing time; and controlling the display, based at least in part upon identification of the degradation;

wherein the source driving circuitry is configured to cause the display to display visual representations by driving image data to a plurality of pixels of the display to cause the plurality of pixels to emit a desired luminance, wherein the image data is provided to the source driving circuitry from a processor of the electronic device.

11. The method of claim 10, comprising identifying the degradation using the resistance test and identification of distances between the data lines.

12. The method of claim 11, comprising identifying degradation in a source driving circuitry of a display of the electronic device, one or more data lines of the display, or both, based at least in part upon performing a capacitance test by:

providing a first charge and a second charge to the one or more data lines and monitoring a difference in change between providing the first charge and the second charge, wherein a first charge for a first data line is different than a first charge for a neighboring data line and wherein a second charge for the first data line is different than a second charge for the neighboring data line;

identifying line lengths for the one or more data lines based upon the difference in charge;

identifying a distance between the first data line and the neighboring data line based upon the mutual capacitance between the first data line and the neighboring data line; and identifying the degradation based upon the line lengths, the distance between the first data line and the neighboring data line, or both.

13. A tangible, non-transitory, machine-readable medium, comprising machine-readable instructions, that when executed by one or more processors of an electronic device, cause the one or more processors of the electronic device to:

generate image data for display by the electronic device;

provide the image data to a display of the electronic device;

identify degradation in source driving circuitry of a display, one or more data lines of the display, or both based upon:

performing a resistance test, wherein the resistance test comprises:

charging the data lines with a reduced data slewing time by charging the data lines for a fixed amount of time that is less than an amount of time that would result in a steady charge on the data lines; and determining a resistance variation of the data lines based upon the reduced data slewing time;

identifying distances between the data lines based upon a mutual capacitance between neighboring data lines of the one or more data lines, by:

driving a first data line of the one or more data lines at a first voltage;

driving a neighboring data line of the first data line at a second voltage different than the first voltage; and calculating the mutual capacitance between a first data line and a neighboring data line, based upon a difference in voltage of the first voltage and the second voltage; and Control the display, based at least in part upon identification of the degradation;

wherein the source driving circuitry is configured to cause the display to display visual representations by driving image data to a plurality of pixels of the display to cause the plurality of pixels to emit a desired luminance.

14. The machine-readable medium of claim 13, comprising instructions to:

control the display to power off when the degradation breaches a threshold of allowed degradation;

control a line time to compensate for added resistance caused by the degradation;

control a slew rate to compensate for the degradation when the degradation comprises a slew rate degradation; or any combination thereof.

* * * * *